US012768238B2

(12) United States Patent
Shao et al.

(10) Patent No.: US 12,768,238 B2
(45) Date of Patent: Oct. 20, 2026

(54) BI-DIRECTIONAL SEAL WITH DUAL SEAL PROFILE SYSTEM AND METHOD

(71) Applicant: Baker Hughes Oilfield Operations LLC, Houston, TX (US)

(72) Inventors: Yong Shao, Suzhou (CN); Yuzhu Hao, Suzhou (CN); Joseph Shu Yian Liew, Singapore (SG)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/947,948

(22) Filed: Nov. 14, 2024

(65) Prior Publication Data

US 2026/0132694 A1 May 14, 2026

(51) Int. Cl.
*E21B 33/04* (2006.01)

(52) U.S. Cl.
CPC ..... *E21B 33/04* (2013.01)

(58) Field of Classification Search
CPC ..... E21B 33/04; E21B 33/1212
See application file for complete search history.

(56) References Cited

U.S. PATENT DOCUMENTS

| | | | | |
|---|---|---|---|---|
| 4,009,893 | A * | 3/1977 | Schatton | E21B 17/042 285/332.3 |
| 5,325,925 | A * | 7/1994 | Smith | E21B 33/04 166/368 |
| 7,740,061 | B2 | 6/2010 | Van Bilderbeek et al. | |
| 8,146,670 | B2 | 4/2012 | Ellis et al. | |
| 8,500,127 | B2 | 8/2013 | Gette | |
| 9,702,201 | B2 | 7/2017 | Nguyen | |
| 11,851,972 | B2 | 12/2023 | Cheng et al. | |
| 2008/0135229 | A1 | 6/2008 | Hunter et al. | |
| 2009/0266551 | A1 | 10/2009 | Cuiper et al. | |
| 2010/0327532 | A1 | 12/2010 | Thomson | |
| 2012/0118585 | A1 | 5/2012 | Duong | |

(Continued)

FOREIGN PATENT DOCUMENTS

CN 205277358 U 6/2016

OTHER PUBLICATIONS

Shinn et al., "Practical Applications for Metal-to-Metal Seals in Oilfield Wellhead Equipment," SPE/IADC 13451, Mar. 1985, doi: https://doi.org/10.2118/13451-MS (5 total pages).

(Continued)

*Primary Examiner* — Dany E Akakpo
(74) *Attorney, Agent, or Firm* — Hogan Lovells Cadwalader US LLP

(57) ABSTRACT

A wellbore system includes a first wellbore component having a tapered interior diameter including a first sealing location and a second sealing location. The wellbore system also includes a second wellbore component with a first flexible seal leg configured to engage the first sealing location, a second flexible seal leg configured to engage the second sealing location, and a slot extending radially into a body of the second wellbore component, the slot forming at least a portion of the first flexible seal leg. The second wellbore component, responsive to a rotational force, is driven into the tapered interior diameter such that the first flexible seal leg forms a first seal at the first sealing location and the second flexible seal leg forms a second seal at the second sealing location.

20 Claims, 10 Drawing Sheets

(56) References Cited

U.S. PATENT DOCUMENTS

| | | | | |
|---|---|---|---|---|
| 2013/0248199 | A1 | 9/2013 | Gette et al. | |
| 2019/0093472 | A1* | 3/2019 | Dewald | E21B 33/165 |
| 2022/0034189 | A1* | 2/2022 | Hendrie | E21B 23/06 |

OTHER PUBLICATIONS

International Search Report and Written Opinion issued in PCT Application No. PCT/US2025/055593 mailed Mar. 31, 2026.

* cited by examiner

BI-DIRECTIONAL SEAL WITH DUAL SEAL PROFILE SYSTEM AND METHOD

BACKGROUND

1. Field of the Disclosure

The present disclosure relates to wellbore operations. Specifically, the present disclosure relates to systems and methods for sealing systems used in wellbore operations.

2. Description of Related Art

Wellbore operations, such as oil and gas exploration and production, injection, and/or the like, may be conducted in a variety of environments, such as subsea or surface environments, where components are installed on a rig or sea floor. Certain components, either within the wellbore, at the wellbore, or outside of the wellbore, may be coupled together with one or more sealing systems used to maintain pressure barriers at various locations associated with the wellbore. Sealing systems may include metallic or polymer seals, among others, that are positioned between different component parts to prevent leakage at various interfaces. Different types of seal materials may be used for a variety of applications, but the selection of different types may change how seals are set, managed, and the like.

SUMMARY

Applicant recognized the problems noted above herein and conceived and developed embodiments of systems and methods, according to the present disclosure, for sealing systems.

In an embodiment, a wellbore system includes a first wellbore component having a bore and a second wellbore component positioned within the bore. The first wellbore component includes a first sealing surface at an uphole axial position, a second sealing surface at a downhole axial position and a first stop shoulder between the first sealing surface and the second sealing surface. The second wellbore component includes an upper flex nose, a slot extending at a downward angle to a position radially closer to an axis of the bore, and a lower flex nose axially lower than the upper flex nose. The second wellbore component is coupled to the first wellbore component with a torquing force such that the upper flex nose is driven radially into the first sealing surface, the lower flex nose is driven radially into the second sealing surface, and an external pressure is directed into the slot to apply a radially outward force to the upper flex nose, on a side opposite the first sealing surface, to increase a sealing force between the upper flex nose and the second sealing surface.

In an embodiment, a bi-direction sealing system includes a first seal between a first wellbore component and a second wellbore component, wherein the first seal is formed at a first interface between a first sealing surface of the first wellbore component and a first surface of a first flexible nose of the second wellbore component, wherein a slot extends into the second wellbore component at a radially interior side of the first flexible nose to direct an external pressure against the first flexible nose to drive first surface into the first sealing surface. The bi-directional sealing system also includes a second seal between the first wellbore component and the second wellbore component, wherein the second seal is formed at a second interface between a second sealing surface of the first wellbore component and a second surface of a second flexible nose of the second wellbore component, wherein the second flexible nose is exposed to a bore pressure of the second wellbore component to receive an internal pressure against the second flexible nose to drive the second surface into the first sealing surface.

In another embodiment, a wellbore system includes a first wellbore component having a tapered interior diameter, the tapered interior diameter including a first sealing location and a second sealing location. The wellbore system also includes a second wellbore component positioned radially inward from the first wellbore component. The second wellbore component includes a first flexible seal leg configured to engage the first sealing location, a second flexible seal leg configured to engage the second sealing location, and a slot extending radially into a body of the second wellbore component, the slot forming at least a portion of the first flexible seal leg. The second wellbore component, responsive to a rotational force, is driven into the tapered interior diameter such that the first flexible seal leg forms a first seal at the first sealing location and the second flexible seal leg forms a second seal at the second sealing location, and wherein the first flexible seal leg is further energized by an external pressure and the second flexible seal leg is further energized by an internal pressure.

In another embodiment, a wellbore system includes a first wellbore component having a tapered interior diameter, the tapered interior diameter including a first sealing location and a second sealing location. The wellbore system also includes a second wellbore component positioned radially inward from the first wellbore component. The second wellbore component includes a first flexible seal leg configured to engage the first sealing location, a second flexible seal leg configured to engage the second sealing location, and a slot extending radially into a body of the second wellbore component, the slot forming at least a portion of the first flexible seal leg. The second wellbore component, responsive to a rotational force, is driven into the tapered interior diameter such that the first flexible seal leg forms a first seal at the first sealing location and the second flexible seal leg forms a second seal at the second sealing location, and wherein the first flexible seal leg is further energized by an external pressure to provide enhanced sealing and the second flexible seal leg is further energized by an internal pressure to provide enhanced sealing.

BRIEF DESCRIPTION OF DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

Figure 1A:
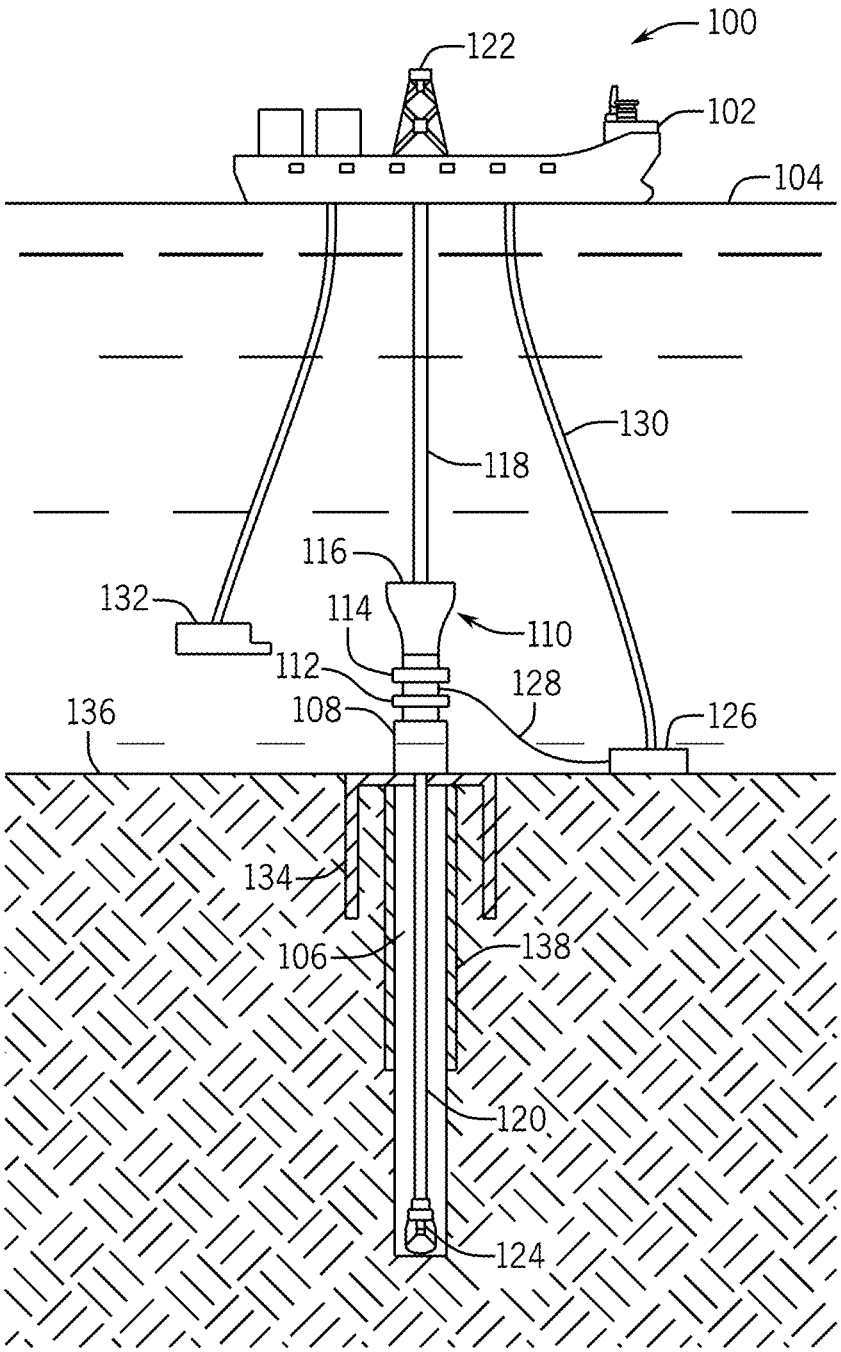
FIG. 1A is a schematic side view of an embodiment of an offshore drilling operation, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. It should be further appreciated that terms such as approximately or substantially may indicate +/−10 percent.

Embodiments of the present disclosure are directed toward a bi-directional metal seal that can be used to form a metal-to-metal (M2M) seal between two or more wellbore components. In at least one embodiment, the bi-directional metal seal may be a flex-type seal that provides sealing from two different directions, including at least pressure from an annulus direction and pressure from a wellbore wall direction (e.g., the annulus side and the production side). Embodiments may be used to provide bi-directional sealing capabilities to withstand pressures from either or both sides of the seal, thereby providing an improved sealing system that may accommodate a variety of different wellbore conditions. Systems and methods may be used to provide a robust seal that may have low torque requirements for both make up and break out. Various embodiments may incorporate two metal flexing profiles, one for internal pressure and another to isolate annulus pressure, to provide sealing capabilities when pressure is acting on both sides of the seal. Embodiments may further provide a sealing system that can be used with a variety of downhole components with lower setting requirements than traditional sealing configurations.

In at least one embodiment, systems and methods of the present disclosure address and overcome problems that may be associated with various downhole systems, such as mudline systems, that may use elastomer seals and/or unidirectional M2M seals. Various embodiments provide sealing systems that may be used to seal from both directions in the well, thereby providing improved reliability and increased operability. Additionally, embodiments may include different sealing configurations and flex profiles that provide low torque energization, which may increase the variety of applications that use the sealing system while also reducing costs for installation. Furthermore, various embodiments may provide a sealing system that includes one or more reusable components. Moreover, various embodiments may provide a sealing system that can be particularly configured for a wide variety of different sizes and may include different coupling systems for a variety of running tools, abandonment caps, tiebacks tools, and the like.

One or more embodiments of the present disclosure may be directed toward a sealing system that may incorporate, at least in part, a bi-directional metal seal with dual metal seal noses. In operation, a mandrel hanger body suspends a casing and receives a tool (e.g., a running tool, a tieback tool, etc.). The mandrel hanger body may be strategically machined to provide a primary metal sealing interface through a differential angle with the tool. The primary M2M contact is produced when torque is applied to make up the tool, driving the metal flex noses into the mandrel hanger body. In at least one embodiment, the mandrel hanger body is furnished with a metal seal profile and differential angles. For example, the metal seal profile may include different angles at different locations to form one or more sealing interfaces. As discussed herein, the tool may thread into the mandrel hanger body, but other embodiments may include different coupling interfaces. In at least one embodiment, both tools are furnished with one or more metal flex noses, but various embodiments discussed herein may refer to at least two metal flex noses, that provide M2M seals between the inner diameter (ID) of the mandrel hanger body and the outer diameter (OD) of the tool. Various embodiments may provide the bi-directional sealing capabilities by forming a slot that directs energizing pressure around an upper metal seal nose. A lower metal seal may be located on the metal seal nose bottom on a tapered OD of the tool. Upon energization, a metal seal is produced when the OD of the tool comes in contact with a differential angle on the mandrel hanger body. As discussed herein, the configuration of the metal seals may provide an enhanced seal in the presence of additional pressures. For example, the metal seal at the lower nose may be further enhanced or energized with internal pressure. The upper metal seal nose may be positioned at an uphole location from the lower metal seal nose and may be arranged proximate a desired location on a tapered OD of the tool. When energized, the upper metal seal nose produces a metal seal when the OD comes in contact with a differential angle on the mandrel hanger body. Furthermore, much like the lower seal, the metal seal at the upper nose is further enhanced or energized with pressure, in this example external pressure. One or more embodiments may also incorporate a stopping shoulder one or both of the mandrel hanger ID and the tool OD between the two metal seals. In operation, the shoulder is used to limit the outward deformation of the tool from not radially collapsing the upper metal seal nose. Various embodiments may include the metal flex nose with particularly selected dimensionality to provide the flexibility for the leg to radially deflect to maintain M2M seals. When set, either the lower metal seal produces the first metal seal followed by the upper metal seal, or the upper metal seal produces the first metal seal followed by the lower metal seal, thereby preventing pressure lock.

FIG. 1A is a side schematic view of an embodiment of a subsea drilling operation 100. It should be appreciated that one or more features have been removed for clarity with the present discussion and that removal or inclusion of certain features is not intended to be limiting, but provided by way of example only. Furthermore, while the illustrated embodiment describes a subsea drilling operation, it should be appreciated that one or more similar processes may be utilized for surface applications and, in various embodiments, similar arrangements or substantially similar arrangements described herein may also be used in surface applications. Additionally, in at least one example, the subsea operation may be referred to as a shallow-water system. Furthermore, a drilling application is provided as a non-limiting example and various systems or methods could also be used in other applications, including recovery, inspection, data collection, and/or the like. The drilling operation includes a vessel 102 floating on a sea surface 104 substantially above a wellbore 106. As noted, the vessel 102 is for illustrative purposes only and systems and methods may further be illustrated with other structures, such as floating/fixed platforms, and the like. A wellbore housing 108 sits at the top of the wellbore 106 and is connected to a blowout preventer (BOP) assembly 110, which may include shear rams 112, sealing rams 114, and/or an annular ram 116. One purpose of the BOP assembly 110 is to help control pressure in the wellbore 106. The BOP assembly 110 is connected to the vessel 102 by a riser 118. During drilling operations, a drill string 120 passes from a rig 122 on the vessel 102, through the riser 118, through the BOP assembly 110, through the wellhead housing 108, and into the wellbore 106. It should be appreciated that reference to the vessel 102 is for illustrative purposes only and that the vessel may be replaced with a floating/fixed platform or other structure. The lower end of the drill string 120 is attached to a drill bit 124 that extends the wellbore 106 as the drill string 120 turns. Additional features shown in FIG. 1 include a mud pump 126 with mud lines 128 connecting the mud pump 126 to the BOP assembly 110, and a mud return line 130 connecting the mud pump 126 to the vessel 102. A remotely operated vehicle (ROV) 132 can be used to make adjustments to, repair, or replace equipment as necessary. Although a BOP assembly 110 is shown in the figures, the wellhead housing 104 could be attached to other well equipment as well, including, for example, a tree, a spool, a manifold, or another valve or completion assembly.

One efficient way to start drilling a wellbore 106 is through use of a suction pile 134. Such a procedure is accomplished by attaching the wellhead housing 108 to the top of the suction pile 134 and lowering the suction pile 134 to a sea floor 136. As interior chambers in the suction pile 134 are evacuated, the suction pile 134 is driven into the sea floor 136, as shown in FIG. 1, until the suction pile 134 is substantially submerged in the sea floor 136 and the wellhead housing 108 is positioned at the sea floor 136 so that further drilling can commence. As the wellbore 106 is drilled, the walls of the wellbore are reinforced with concrete casings 138 that provide stability to the wellbore 106 and help to control pressure from the formation. It should be appreciated that this describes one example of a portion of a subsea drilling operation and may be omitted in various embodiments. In at least one embodiment, systems and methods of the present disclosure may be used for drilling operations that are completed through a BOP and wellhead, where a casing hanger and string are landed in succession. As noted above, configurations with respect to a sea floor or any offshore application are for illustrative purposes and embodiments of the present disclosure may also be utilized in surface drilling applications.

Figure 1B:
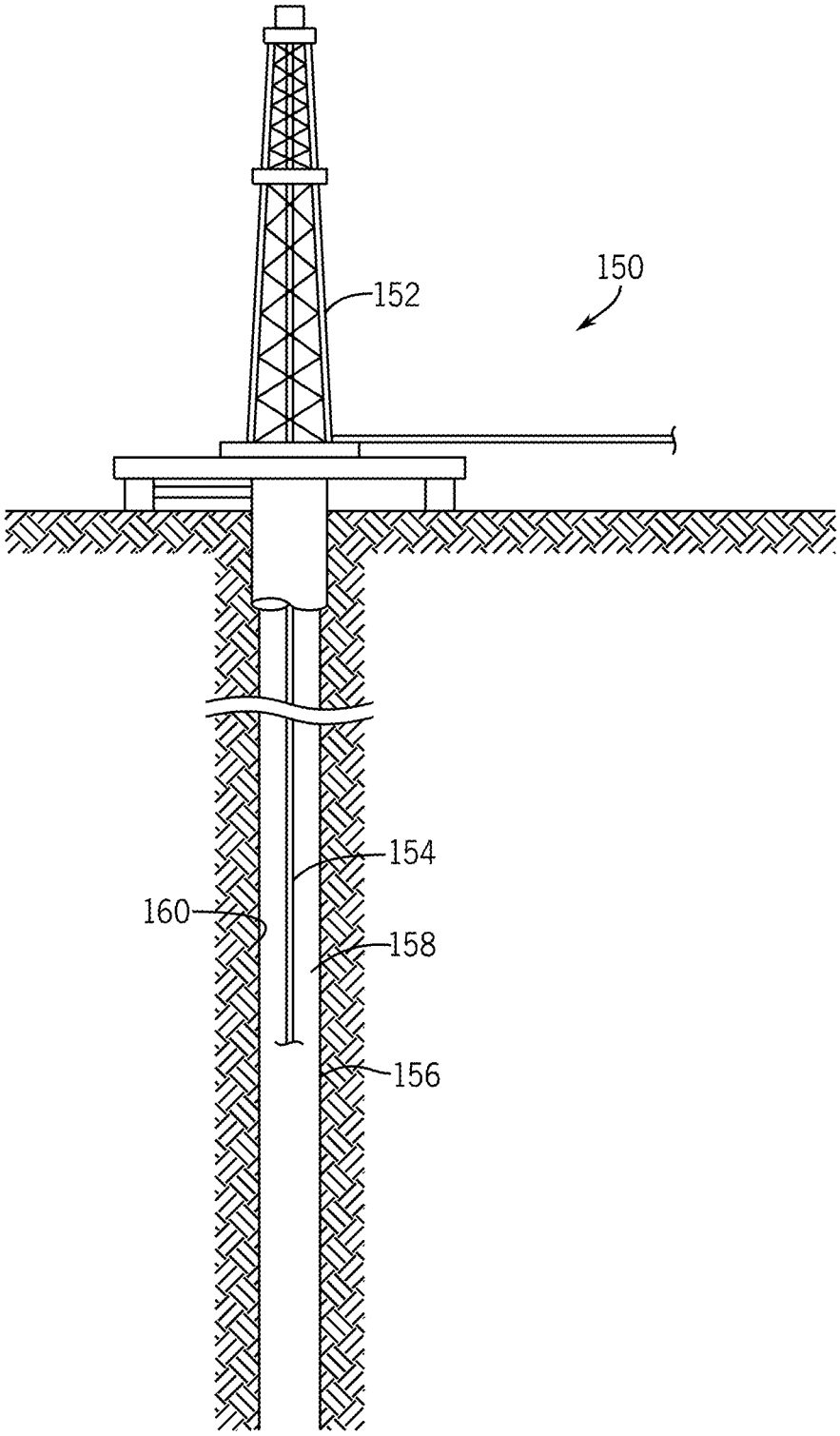
FIG. 1B is a cross-sectional side view of an embodiment of a wellbore system, in accordance with embodiments of the present disclosure.

FIG. 1B is a schematic side view of an embodiment of a wellbore system 150, which may include a completion system, a recovery system, or a drilling system. In this example, the wellbore system 150 a rig 152 and a string 154 coupled to the rig 152. The string 154 may extend through a wellhead assembly (not pictured) such as a blowout preventer (BOP) and/or one or more valve configurations. The wellhead assembly may be a surface assembly, which is not visible in the illustrated embodiment due to a platform of the rig 152, but it should be appreciated that it may be provided in various embodiments. Systems and methods may be utilized in embodiments where one or more completion or recovery operations are initiated, such as when the string 154 is suspended into a wellbore 156. In this example, the string 154 may be a completion or production string, which may include one or more tubulars coupled together and suspended from one or more features, such as the wellhead assembly and/or a casing/tubing hanger, among other options. It should be appreciated that the string 154 may also be a casing string, where one or more cementing operations may be used to cement and secure the string 154 to a wellbore wall. Furthermore, various embodiments may also implement such configurations during drilling operations, where the string 154 includes a drill bit at an end.

In this example, the string 154 is suspended into an annulus 158 formed between the string 154 and a wellbore wall 160. The string 154, as noted above, may be secured to one or more assembly that are configured to receive and support the string 154, such as a hanger assembly. In operation, the hanger assembly may be arranged within the wellbore 156, or at a surface location, and may include one or more seals to control pressure within the wellbore. Embodiments of the present disclosure may be incorporated with one or more of exploration, drilling, completion, and/or recovery efforts associated with subsea and/or surface applications. Furthermore, embodiments may also be used with various intervention or injection operations, among other uses for wellbores.

Various embodiments of the present disclosure incorporate one or more sealing systems that may be incorporated into different sealing configurations between various components, such as between a mandrel hanger body and one or more additional tools, such as a running tool and/or a tieback tool, among other options. Embodiments may include a sealing system with two flexible legs that may be used to generate an upper M2M seal and a lower M2M seal. Systems and methods of the present disclosure may further provide for flow paths that may be used to enhance sealing capabilities at the lower seal due to external pressures and to enhance sealing capabilities at the upper seal due to internal pressures. In this manner, bi-directional sealing may be accomplished while maintaining M2M interfaces between components.

Figure 2A:
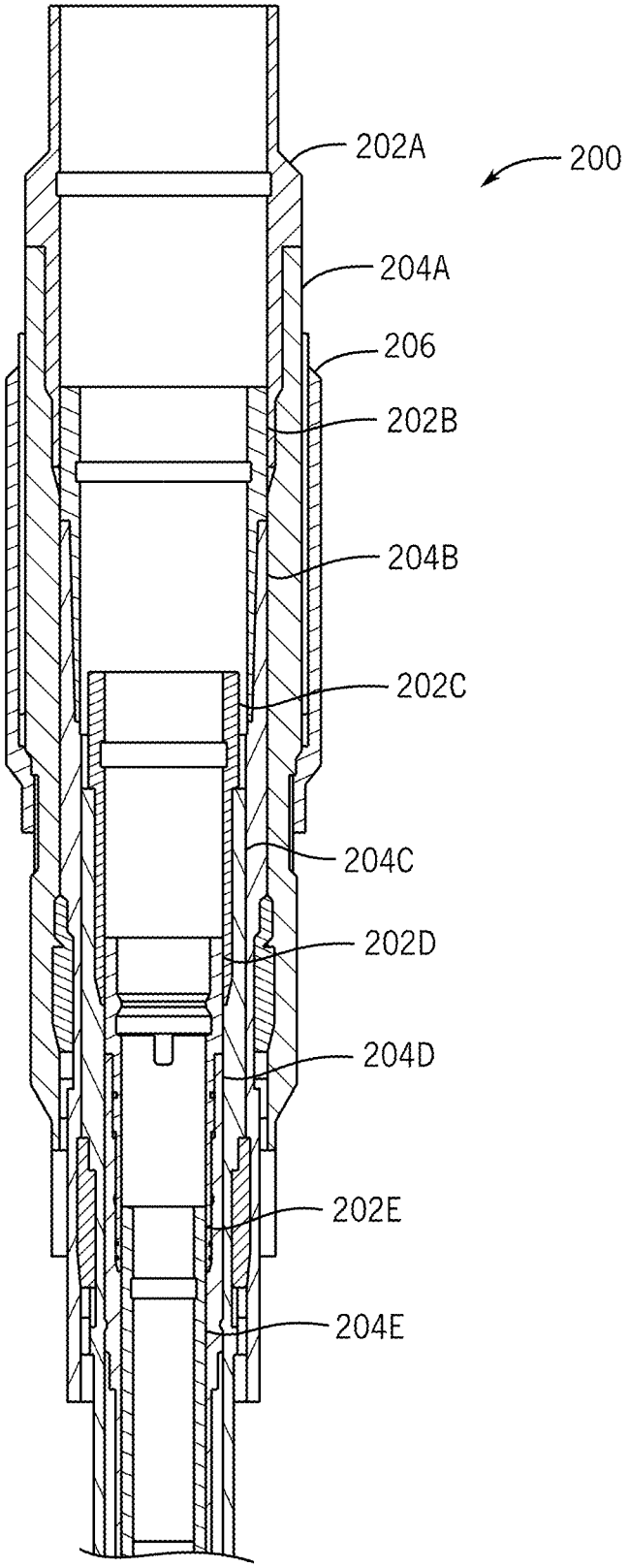
FIG. 2A is a cross-sectional side view of an embodiment of a wellbore system, in accordance with embodiments of the present disclosure.

FIG. 2A is a cross-sectional view of an embodiment of a wellbore system 200 that may be used with embodiments of the present disclosure. In this example, a multi-barrier system is illustrated that includes a number of running tools, casing hangers, and the like. As shown, when a wellbore is formed for downhole exploration or production, such as in the oil and gas industry, an upper diameter at a first wellbore section is larger than respective diameters of lower sections, as different hangers or the like may be installed, secured, and then drilled through during formation of the wellbore. Starting from the largest, top assemblies, a running tool 202A is shown coupled to a casing hanger 204A that is secured to a landing ring 206. Moving axially downward along the wellbore, a smaller diameter running tool 202B is secured to a smaller diameter casing hanger 204B. This process repeats for subsequent running tools 202C-202E and casing hangers 204C-204E. At various interfaces, between the respective running tools 202 and casing hangers 204, it may be desirable to form a seal, such as a M2M seal, to prevent leaks from a formation and/or from an annulus. However, as discussed herein, typical sealing configurations are either only uni-directional and/or may not include M2M capabilities, for example by including elastomers or other types of seals. Embodiments of the present disclosure address and overcome these problems by forming M2M seals with reduced setting pressures while further providing bi-directional sealing capabilities.

Figure 2B:
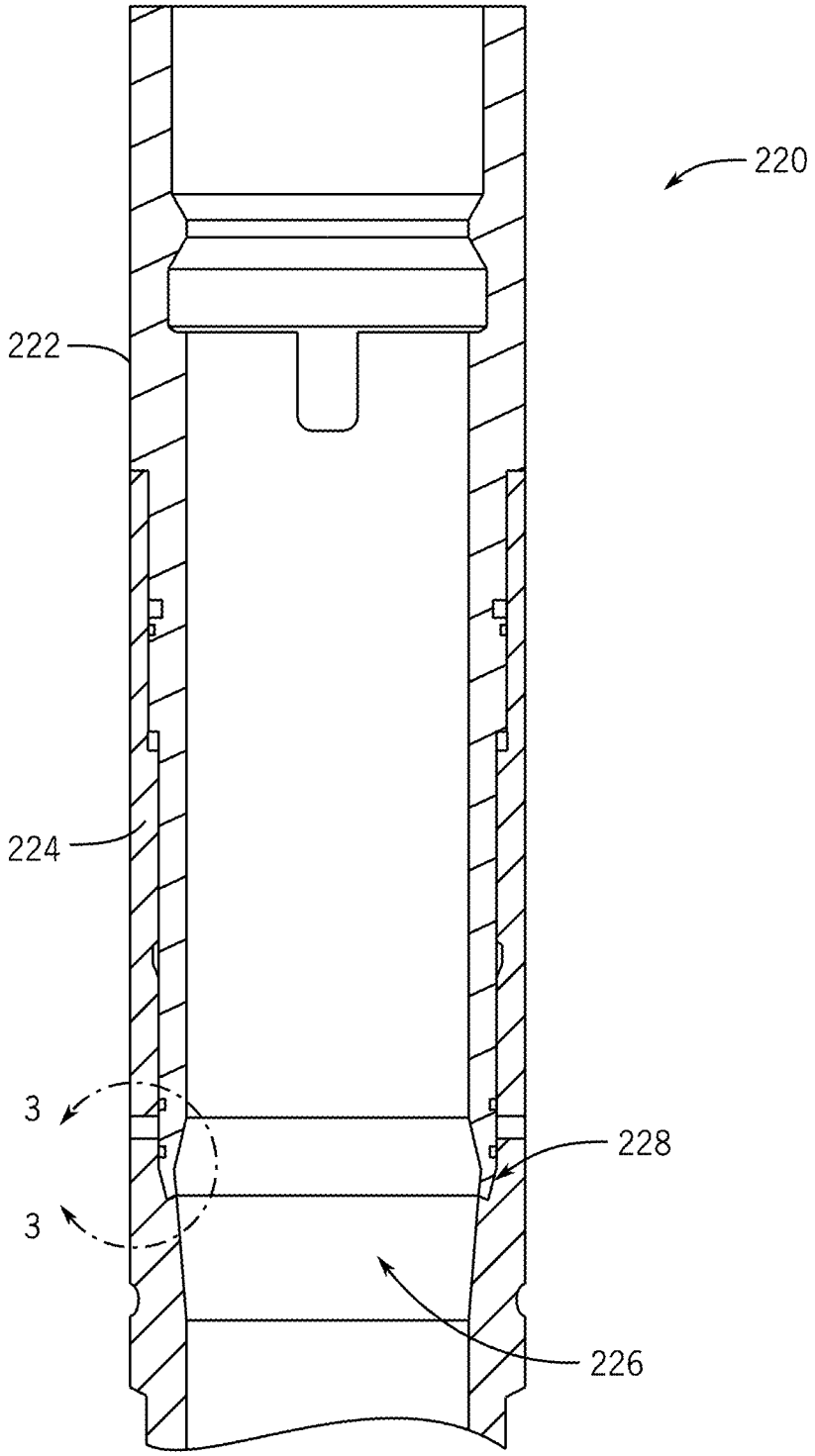
FIG. 2B is a cross-sectional side view of an embodiment of a wellbore system, in accordance with embodiments of the present disclosure.

FIG. 2B is a cross-sectional view of an embodiment of a wellbore system 220 that may be used with embodiments of the present disclosure. In this example, the wellbore system 220 includes a tool 222, which may be a running tool or a tieback tool, among various other options. The tool 222 is engaged with a mandrel hanger body 224. As shown, the tool 222 extends into a bore 226 of the mandrel hanger body 224. One or more sealing systems 228 (e.g., sealing assemblies) may used to form one or more M2M seals between the tool 222 and the mandrel hanger body 224. The sealing systems 228 may be incorporated into one or more portions of the tool 222 and/or the mandrel hanger body 224. For example, as discussed herein, the tool 222 may include flexible legs and/or noses that may be driven into one or more sealing surfaces of the mandrel hanger body 224 to generate the M2M seals between the components.

Figure 3:
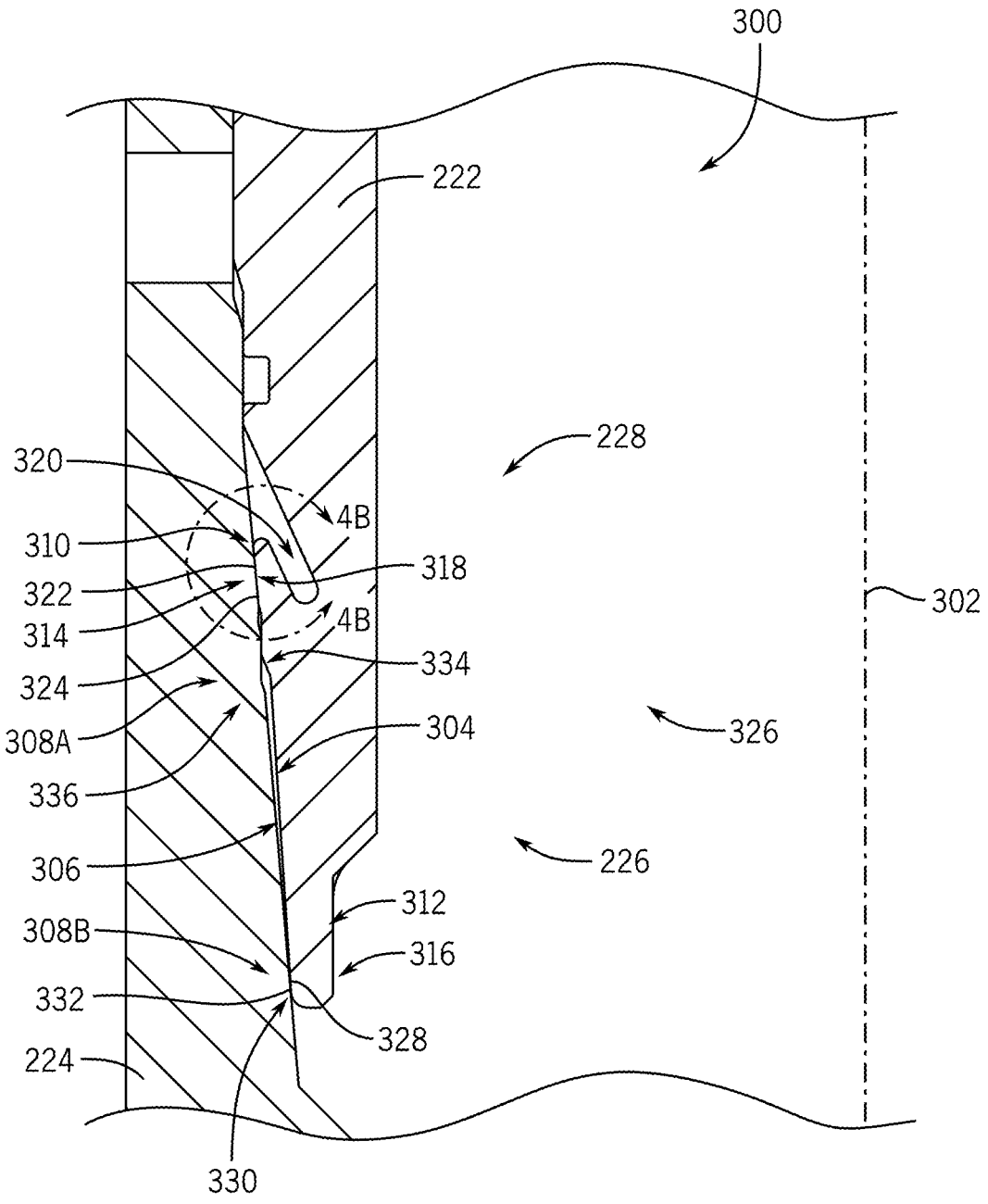
FIG. 3 is a cross-sectional side view of an embodiment of a sealing configuration taken along 3-3, in accordance with embodiments of the present disclosure.

FIG. 3 is a schematic cross-sectional view taken along 3-3 of a sealing configuration 300 that may be used with embodiments of the present disclosure. In this example, the sealing system 228 is illustrated as part of the tool 222 and the mandrel hanger body 224, for example, by including the various sealing noses and various sealing surfaces discussed herein. That is, the sealing system 228 may include one or more components that are carried on the tool 222 and/or the mandrel hanger body 224 that, when interacting, collectively form the sealing system 228. However, it should be appreciated that various other embodiments may incorporate one or more additional components, such as components that may be coupled to the tool 222 and/or the mandrel hanger body 224, that may form at least a portion of the sealing system 228. The illustrated tool 222 is positioned within the bore 226 of the mandrel hanger body 224 along an axis 302 (e.g., a longitudinal axis, a wellbore axis, a hanger axis, etc.). Each of the tool 222 and the mandrel hanger body 224 may be annular components, and as a result, the respective "sides" or "portions" radially closer to the axis 302 may be referred to as the ID while the "sides" or "portions" radially farther from the axis 302 may be referred to as the OD. That is, an OD 304 of the tool 222 is configured to engage an ID 306 of the mandrel hanger body 224.

In operation, the mandrel hanger body 224 is used to suspend casing and receives the tool 222 along the ID 306. In at least one embodiment, the mandrel hanger body 224 includes one or more sealing surfaces associated with one or more sealing profiles 308, which may be particularly machined to provide a primary metal sealing interface through a differential angle between the tool 222 and the mandrel hanger body 224. As discussed herein, the sealing profile 308 may be used to refer to portions of the mandrel hanger body 224 and/or the tool 222 because the profile of one or both components may be used to adjust sealing capabilities. These profiles may be particularly selected and machined based on a variety of factors, such as intended operating configurations, manufacturing capabilities, and/or the like. The primary M2M seal is produced when torque is applied to making up the tool 222, driving metal flex noses 310, 312 (e.g., legs) of the tool 222 into the mandrel hanger body 224. In operation, the sealing profile 308 may include specially machined surfaces, sloped surfaces to from differential angles, and/or combinations thereof. Moreover, the sealing profiles 308 may different at different locations along the axis 302. For example, a sealing profile 308A associated with the interface between the upper flex nose 310 (e.g., leg, upper leg) and the mandrel hanger body 224 may have a different angle or configuration than the sealing profile 308B associated with the interface between the lower flex nose 312 (e.g., leg, lower leg) and the mandrel hanger body 224.

In this example, the tool 222 threads into the mandrel hanger body 224, but it should be appreciated that various other embodiments may include different coupling mechanisms. As the tool 222 is torqued, each of the noses 310, 312 are driven into the mandrel hanger body 224, thereby forming an upper seal 314 and a lower seal 316. For example, different sealing surfaces at the respective upper and lower seals 314, 316 may generate sealing interfaces that are used to block fluid flow between the tool 222 and the mandrel hanger body 224. The individual seals 314, 316 may be associated with the individual profile 308A, 308B.

Turning to the upper seal 314, the upper flex nose 310 is positioned proximate a sealing location 318 such that, when pressure is introduced, either through the torque applied to the tool 222 and/or from fluid within a slot 320, the upper flex nose 310 is driven into the ID 306 at the sealing location 318. In at least one embodiment, the OD 304 at the upper flex nose 310 may include a tapered surface 322, which may be driven into a sealing surface 324 of the mandrel hanger body 224. In various embodiments, the sealing surface 324 may include a slope or tapered formation, which may provide a differential angle between the surfaces 322, 324, thereby forming the M2M seal at the upper seal 314. Various embodiments may refer to the sealing profile 308A as including features for one or both of the tapered surface 322 or the sealing surface 324.

While the upper seal 314 may be set during installation of the tool 222, for example after setting the lower seal 316 to avoid vapor lock, the slot 320 may be configured to receive pressure (e.g., tubing/casing annulus (TCA) pressure), which may drive the upper flex nose 310 into the mandrel 224 to enhance and increase the sealing capabilities at the upper seal 314. With traditional uni-directional seals, TCA pressure would drive sealing surfaces apart, thereby reducing sealing capabilities of the system. Embodiments of the present disclosure address and overcome this problem by forming the slot 320 to extend radially inward (e.g., to have a downward facing slope toward the axis 302), and as a result, TCA pressure is applied on a radially inward surface of the upper flex nose 310 to drive the upper flex nose 310 radially outward away from the axis 302 and into the mandrel hanger body 224.

In various embodiments, a slot length may be particularly selected based on a desired stiffness of the upper flex nose 310. For example, a slot length below a threshold may lead to a very stiff nose 310, while a slot length above a threshold may lead to a nose 310 that flexes too readily. The ratio of the slot length to the sloth width may be approximately three to one or approximately four to one.

Also illustrated is the lower seal 316, which may include its own tapered surface 328, that is driven into a sealing location 330 of the mandrel hanger body 224. As discussed with respect to the upper seal 314, the sealing location 330 may include a tapered sealing surface 332 that may be used to from a differential angle with the tapered surface 328 of the lower seal 316 to generate the M2M seal at the lower seal 316. Various embodiments may refer to the sealing profile 308B as including one or more features of the tapered surface 328 and/or the sealing surface 332. In this configuration, pressure from an annulus 326 drives the lower flex nose 312 radially outward and away from the axis 302 and into the mandrel hanger body 224, thereby enhancing sealing capabilities of the system.

Further shown is a stop shoulder 334 positioned between the upper flex nose 310 and the lower flex nose 312. The illustrated stop shoulder 334 is arranged along the OD 304 of the tool 222 and engages a mating stop shoulder 336 on the ID 306 of the mandrel hanger body 224. In operation, the stop shoulders 334, 336 may limit the outward deformation of the tool 222. For example, the configuration of the upper and lower flex noses 310, 312 may prevent radial collapse of the upper flex nose 310 when paired with the stop shoulders 334, 336. Additionally, the stop shoulders 334, 336 may be used to accurately position the components to form the seals 314, 316. For example, the noses 310, 312 may be positioned relative to the stop shoulder 334, 336 because contacting the stop shoulders 334, 336 may provide an indication that the noses 310, 312 are located at a desired position. Without the stop shoulders 334, 336, there may be a risk of overtravel, which would misalign the sealing interfaces, which may lead to overflexing of the seals.

Systems and methods of the present disclosure may be used to form a bi-directional M2M seal between the tool 222 and the mandrel hanger body 224, and as a result, pressure from either within the wellbore or external to the wellbore may be used to generate additional sealing forces to prevent leakage between the tool 222 and the mandrel hanger body 224. As discussed herein, the mandrel hanger body 224 may be used to suspend casing and may receive the tool 222 within the bore 226. To form the M2M seal, one or both of the tool 222 and/or the mandrel hanger body 224 may have particularly machined surfaces to provide a primary metal sealing interface. Differential angles arranged at the sealing locations 318, 330 may facilitate formation of the M2M seal. For example, different surfaces may have different slopes and/or angles, thereby providing a sealing interface when the tool 222 is torqued. For example, torquing the tool 222 may drive the flex noses 310, 312 into the mandrel hanger body 224 at the respective sealing locations 318, 330.

Torquing the tool 222 may thread the tool 222 into the mandrel hanger body 224 and drive the flex noses 310, 312 into and against the ID 306 of the mandrel hanger body 224, thereby forming seals between the ID 306 and the OD 304 of the tool 222. As discussed herein, the slot 320 may further be used to maintain pressurization and engagement of the upper seal 314, for example by providing a pressurizing force on a backside (e.g., side closer to the axis 302) of the upper flex nose 310, thereby driving the upper flex nose 310 into the ID 306 of the mandrel hanger body 224.

In at least one embodiment, the lower seal 316 is formed between the mandrel hanger body 224 and the tool 222 along a tapered location of the tool 222. The lower seal 316 may be formed by engagement between the lower flex nose 312, for example at the tapered surface 328, and the mandrel hanger body 224, for example along the sealing surface 332. As the lower flex nose 312 is energized, the M2M seal may be produced when the OD 304 of the tool 222 comes into contact with the ID 306 of the mandrel hanger body 224. As discussed herein, a differential angle may be arranged along one or more sealing surfaces in order to facilitate formation of the M2M seal. In certain embodiments, the M2M seal may be further enhanced or energized with internal (e.g., annulus) pressure. For example, pressure within the annulus is applied to a backside (e.g., a side closer to the axis 302), the lower flex nose 312 may be driven into the mandrel hanger body 224.

Returning to the upper seal 314, which in this configuration is arranged axially uphole of the lower seal 316 and is also axially uphole of the stop shoulders 334, 336, the upper seal 314 may be formed between an upper tapered portion of the tool 222 and the mandrel hanger body 224. In this configuration, as the tool 222 is torqued, the upper flex nose 310 may be energized and driven into the mandrel hanger body 224, for example at the upper sealing location 318. As discussed herein, there may be a differential angle between the OD 304 of the tool and the ID of the mandrel hanger body 224, thereby facilitating M2M seal formation at the tapered surface 322 and the sealing surface 324. In at least one embodiment, the M2M seal at the upper seal 314 is further enhanced or energized with external pressure (e.g., TCA pressure). For example, external pressure may drive the upper flex nose 310 radially inward toward the axis 302, however, pressure within the slot 320 may overcome the external pressure to provide an improved sealing engagement.

Systems and methods of the present disclosure are directed toward a flex pressure energized metal seal. In operation, a metal seal profile acts like a lip or leg which flexes outward to engage a wellbore component, such as the mandrel hanger body 224, because of the differential angle between the noses 310, 312 and the mandrel hanger body 224. The differential angle will create the M2M seal when the tool 222 is driven downwards. Embodiments of the present disclosure address and overcome problems with traditional flex type energized seals that provide sealing from one direction. With these traditional seals, sealing is enhanced as pressure within the well is increased because pressure drives the leg into the wellbore content to apply more contact pressure. However, if pressure is introduced from behind (e.g., on the annulus side), the seal in the traditional flex type energized seals will unseat due to being forced radially inward. Systems and methods of the present disclosure provide bi-directional sealing capability by introducing the slot 320 associated with the upper flex nose 310 to apply TCA pressure to the radially inward side of the upper flex nose 310, thereby increasing the contact pressure between the tool 222 and the mandrel hanger body 224.

Various embodiments are directed toward using M2M seals, which may refer to both a metallic flexing component and a metallic mating sealing face. Metal seals may be useful in various applications because they do not degrade due to exposure to various fluids, such as hydrocarbons. Additionally, metal seals may be more robust and more stable. However, metal seals are often stiffer than alternatives, such as elastomers, and as a result, may require more torque for making up and breaking out. For example, as the tool 222 is introduced into the mandrel hanger body 224, there is resistance from the metals at the contacting interface. Embodiments of the present disclosure may be used to particularly select different sealing properties, such as the differential angles, to reduce or otherwise decrease a make up/break out torque. For example, traditional M2M seals that are set with threaded profiles may use upwards of 60,000 foot pounds of pressure for make up. Break out is different, requiring larger equipment and increase time. Embodiments of the present disclosure, however, provide a lower torque, high reliability M2M seal. For example, systems may use approximately one-tenth of the break out force from traditional seals, thereby permitting operation in temporary situations, such as abandonment caps or tieback systems. Various embodiments may be used with a wide variety of configurations, such as mudline systems, by way of non-limiting example. For example, mudline systems may provide arrangements where annulus pressure could infiltrate the seals, and as a result, the bi-directional sealing capabilities of the embodiments discussed herein may be used to address and overcome these problems.

Figure 4A:
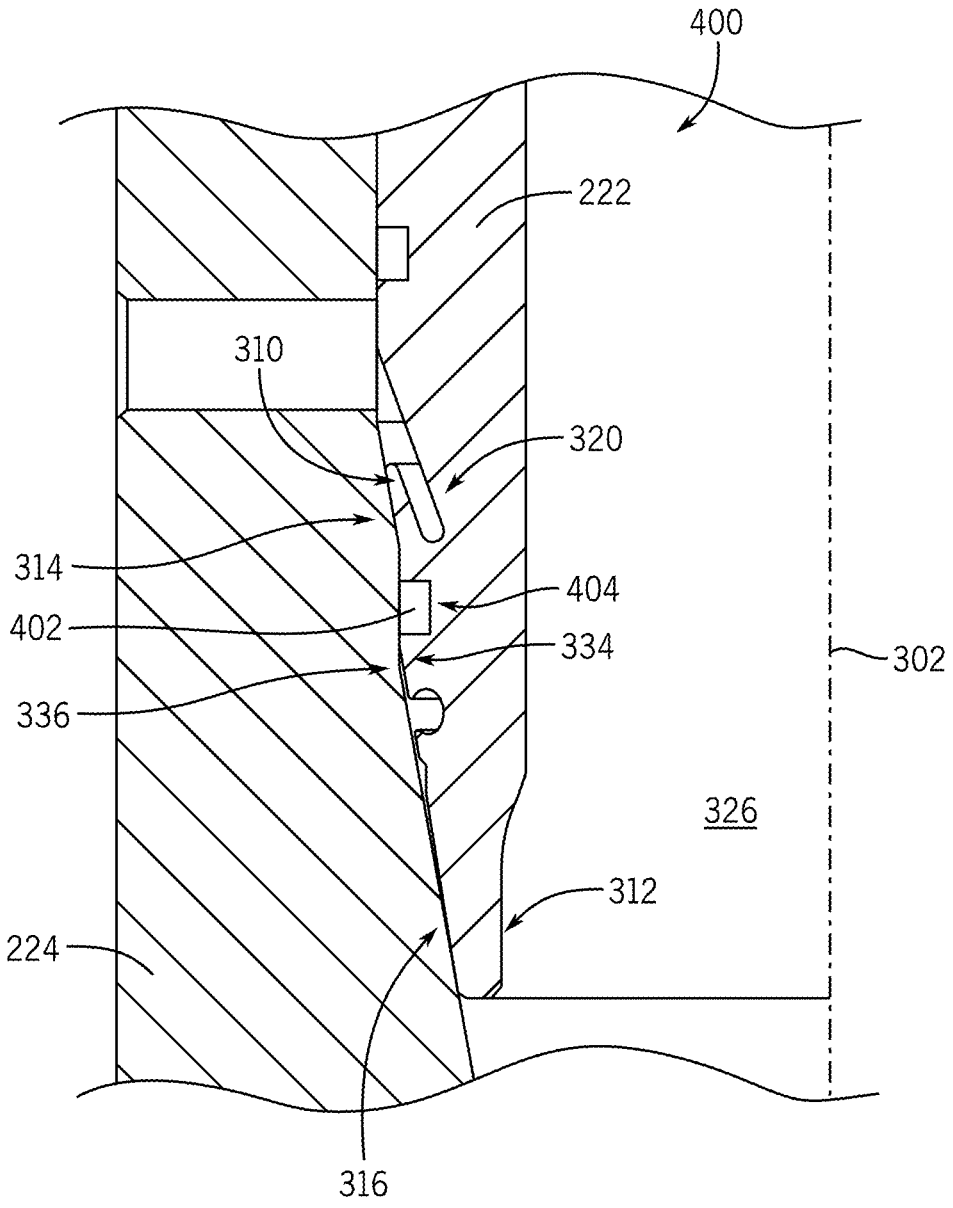
FIG. 4A is a cross-sectional side view of an embodiment of a sealing configuration, in accordance with embodiments of the present disclosure.

FIG. 4A illustrates a cross-sectional side view of an embodiment of a sealing configuration 400 in which an additional seal 402 is arranged between the upper flex nose 310 and the lower flex nose 312. The additional seal 402 may be an elastomeric seal arranged within a groove 404 formed in the tool 402. The use of the additional seal 402 may provide a secondary or backup seal for the upper flex nose 310 and the lower flex nose 312. In this example, the additional seal 402 is axially above the shoulders 334, 336, but it should be appreciated that the seal 402 may also be below the shoulders 334, 336 or may be both above and below the shoulders 334, 336.

Figure 4C:
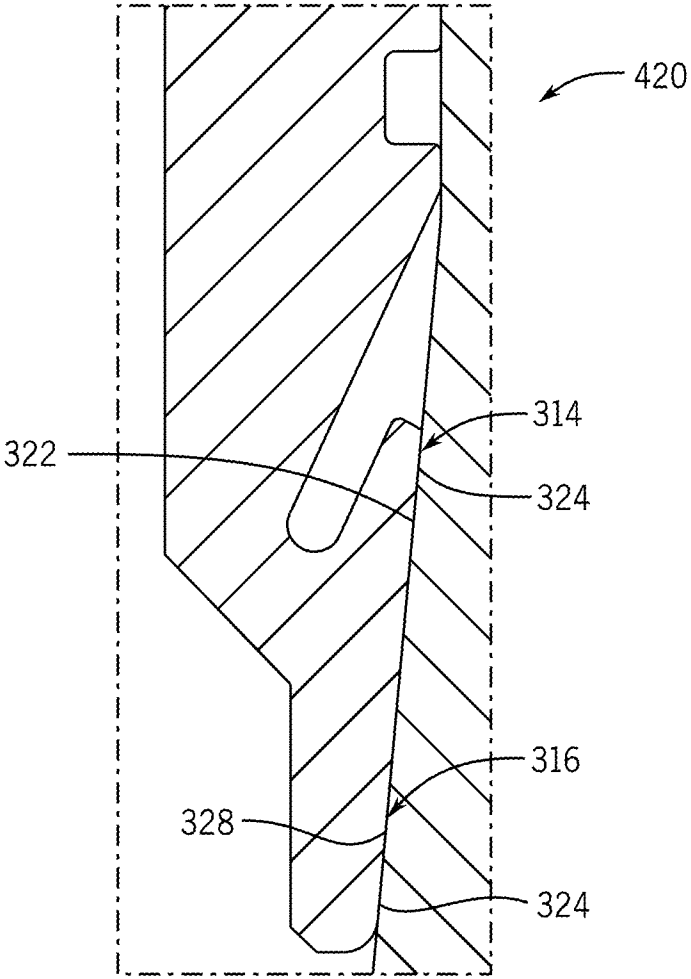
FIG. 4C is a cross-sectional side view of an embodiment of a sealing configuration, in accordance with embodiments of the present disclosure.
Figure 4B:
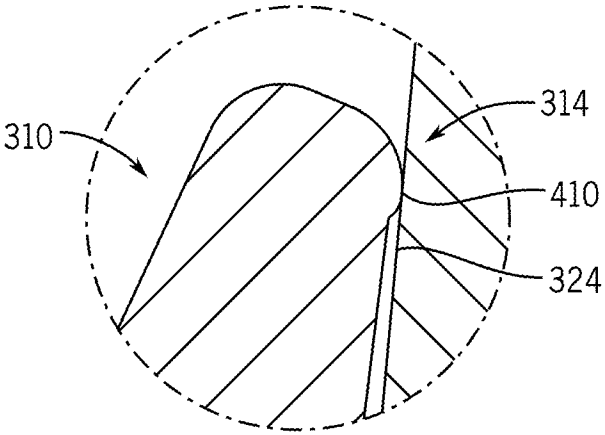
FIG. 4B is a detailed cross-section side view of an embodiment of a flex nose taken along 4B-4B, in accordance with embodiments of the present disclosure.

FIG. 4B illustrates a cross-sectional detailed view of the upper flex nose 310 taken at 4B-4B. In this configuration, the upper flex nose 310 includes a raised sealing band 410, which may be positioned to contact and engage the sealing surface 324 and provide a sealing band contact. While only the upper flex nose 310 is illustrated in FIG. 4B, it should be appreciated that a similar raised sealing band may also be used with respect to the lower flex nose 312.

FIG. 4C illustrates a cross-sectional view of an embodiment of a sealing configuration 420 in which both metal seals formed at the upper seal 314 and the lower seal 316 have matching tapers. For example, the sealing surfaces 322, 328 associated with the seals 314, 316 may be substantially the same, such as having the same taper. In at least one embodiment, the mating surfaces 324, 332 may also have the same profile.

Figure 4D:
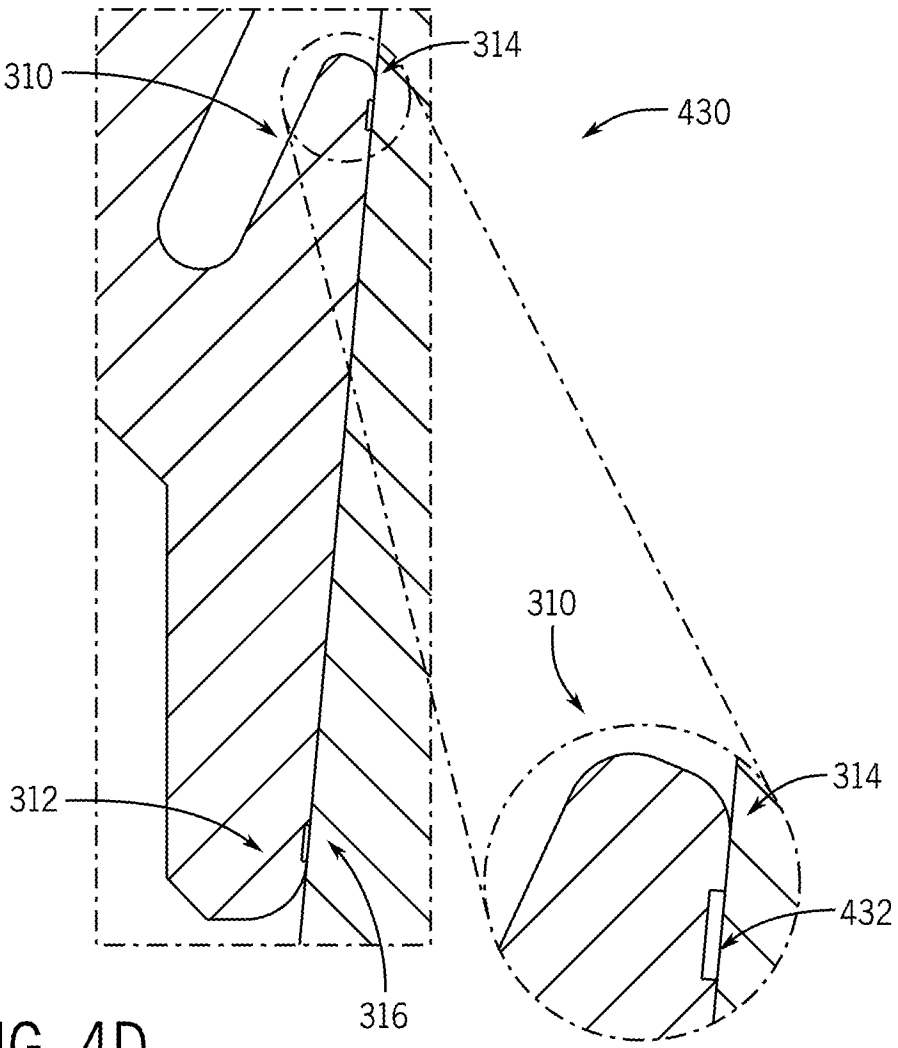
FIG. 4D is a cross-sectional side view of an embodiment of a sealing configuration, in accordance with embodiments of the present disclosure.

FIG. 4D illustrates a cross-sectional view of an embodiment of a sealing configuration 430 in which inlays 432 are included on the flex noses 310, 312. The inlays 432 may be formed of a softer material compared to the remainder of the flex noses 310, 312, thereby providing for improved crushing or deformation at the seals 314, 316 to generate the M2M seal. It should be appreciated that a size of the inlays 432 may be particularly selected based on a variety of operating conditions, such as a size of the flex noses 310, 312, length of a sealing interface, and/or combinations thereof.

Figure 5A:
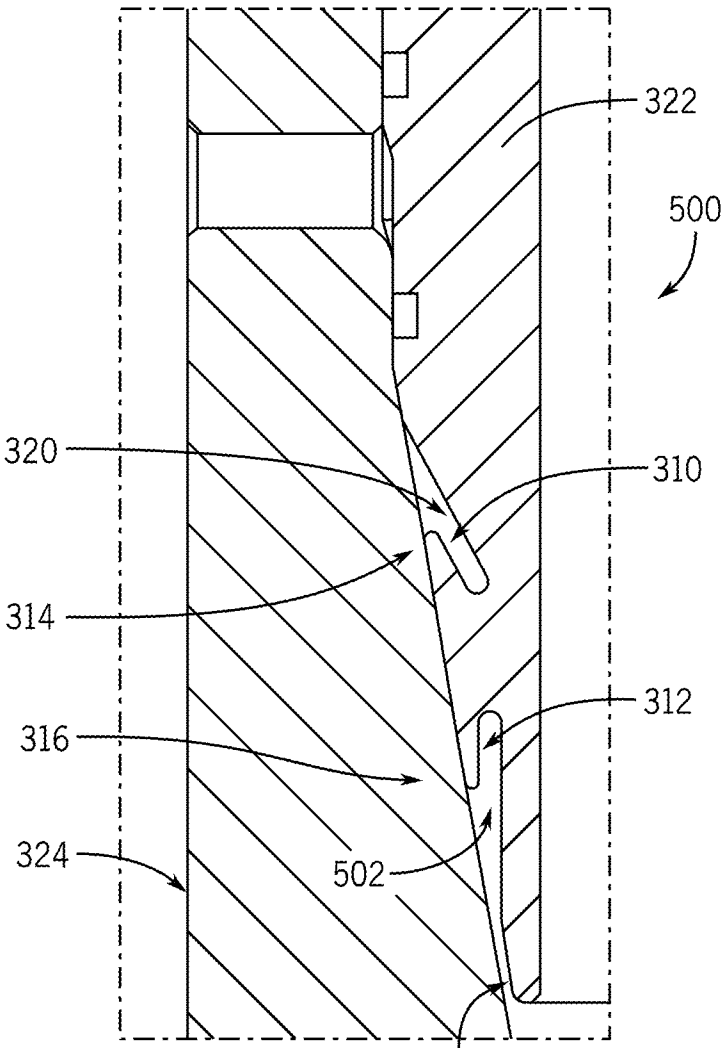
FIG. 5A is a cross-sectional side view of an embodiment of a sealing configuration, in accordance with embodiments of the present disclosure.

FIG. 5A illustrates a cross-sectional view of an embodiment of a sealing configuration 500 in which a second slot 502 is added for the lower flex nose 312. In this configuration, the slot 320 may be considered a downward facing slot and the second slot 502 may be considered an upward facing slot. In this non-limiting example, the second slot 502 has a substantially vertical arrangement, but the second slot 502 may also be angled, for example toward or away from the axis 302. Each of the slots 320, 502 may be used to direct pressure toward a radially inward portion of a respective flex nose 310, 312, thereby enhancing sealing capabilities by driving the flex noses 310, 312 against the mandrel hanger body 224. The illustrated configuration also includes a skirt 504 that may be used as guiding tool. In this example, the skirt 504 is axially lower than the lower flex nose 312 and may be used to center or otherwise position the tool 222 within the bore 226 of the mandrel hanger body 224.

Figure 5C:
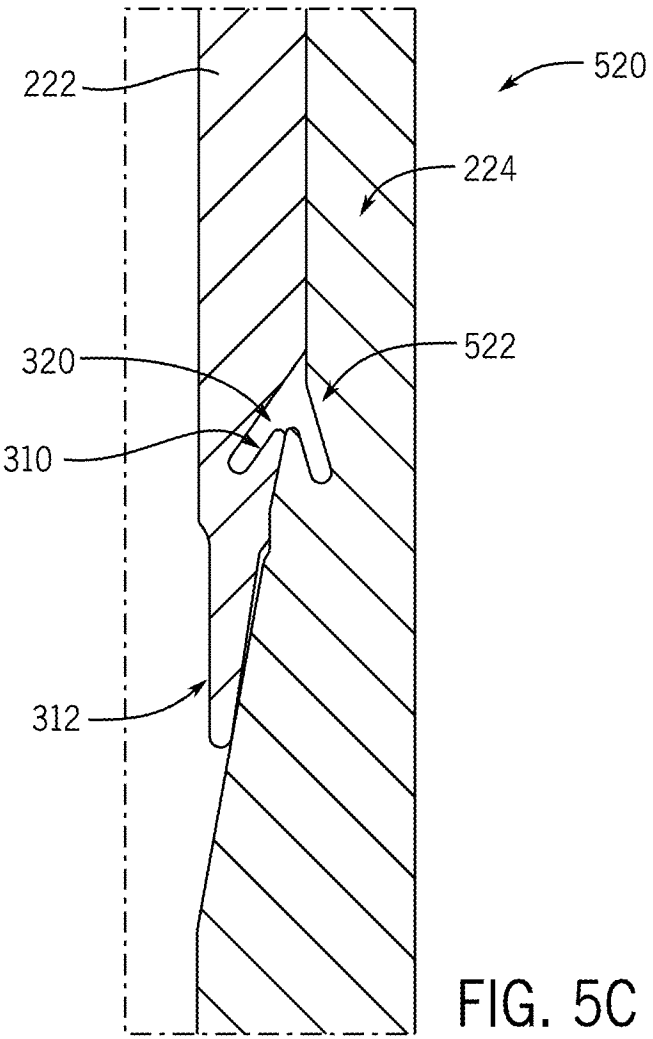
FIG. 5C is a cross-sectional side view of an embodiment of a sealing configuration, in accordance with embodiments of the present disclosure.
Figure 5B:
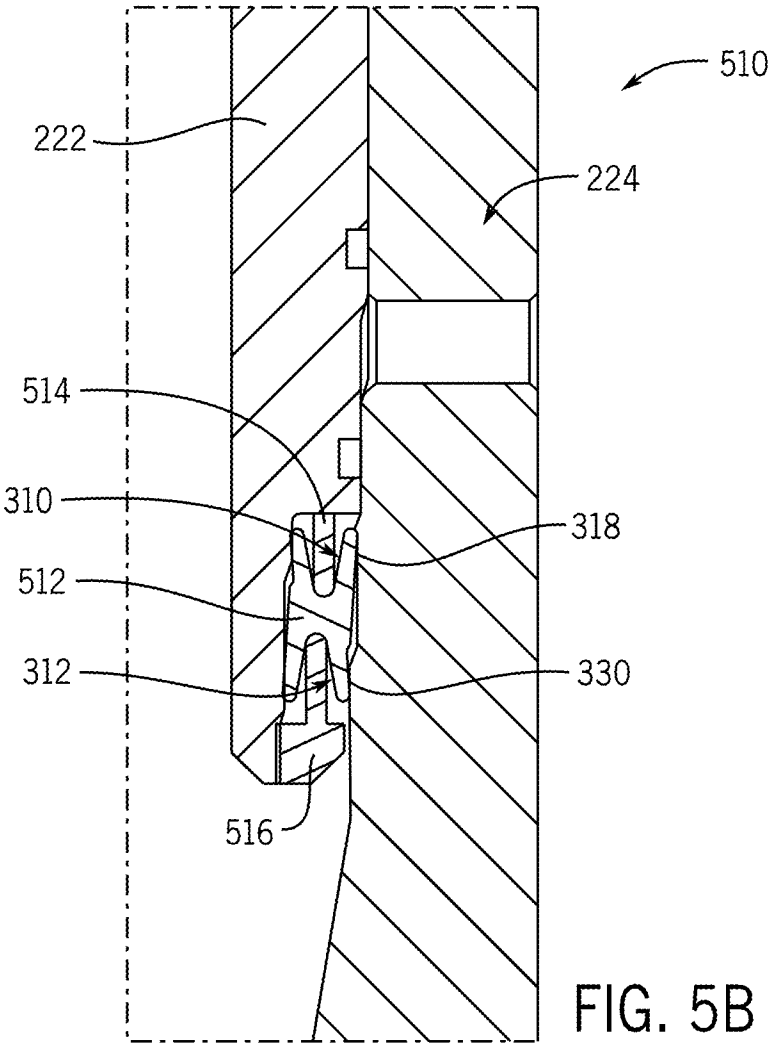
FIG. 5B is a cross-sectional side view of an embodiment of a sealing configuration, in accordance with embodiments of the present disclosure.

FIG. 5B illustrates a cross-sectional view of an embodiment of a sealing configuration 510 in which the upper and lower flex noses 310, 312 are formed on a replaceable seal 512 that is maintained in position within a recess 514 by a retainer ring 516 and a stop ring 518. In this configuration, the tool 222 may be driven into the bore 226 of the mandrel hanger body 224 to align the replaceable seal 512 with one or more sealing locations 318, 330. The retainer ring 516 may be coupled to the tool 222, for example using one or more threads, and the retainer ring 516 and stop ring 518 may be used to maintain the replaceable seal 512 and associated noses 310, 312 in an intended position to facilitate sealing against the mandrel hanger body 224.

FIG. 5C illustrates a cross-sectional view of an embodiment of a sealing configuration 520 in which the mandrel hanger body 224 includes a slot 522, which may also be referred to as an upward facing slot. In this configuration, the slot 522 is substantially aligned with the slot 320. In operation, pressure may enter the slot 522 to stiffen or otherwise support the mandrel hanger body 224 as the upper flex nose 310 is driven into the mandrel hanger body 224.

Figure 5D:
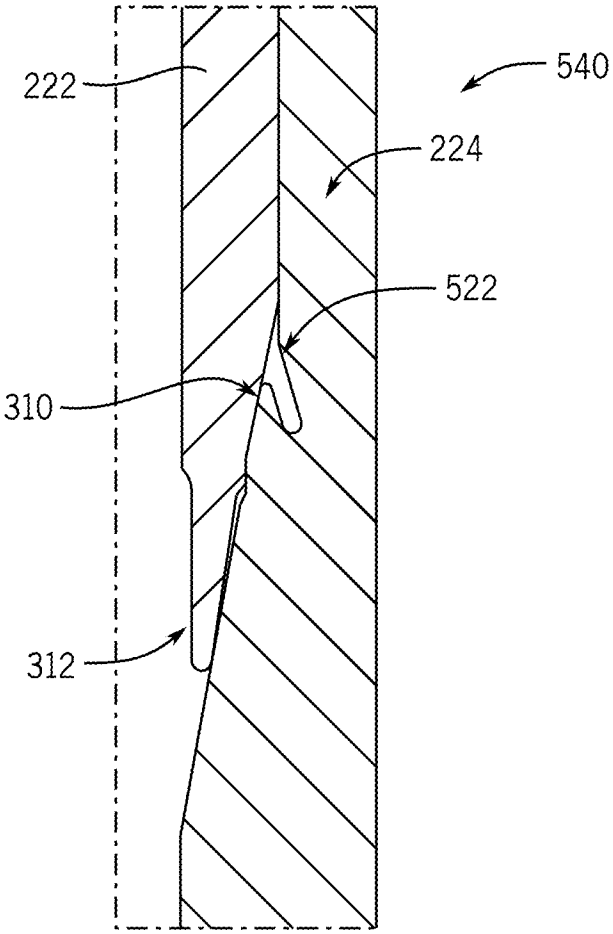
FIG. 5D is a cross-sectional side view of an embodiment of a sealing configuration, in accordance with embodiments of the present disclosure.

FIG. 5D illustrates a cross-sectional view of an embodiment of a sealing configuration 540 in which the slot 522 in the mandrel hanger body 224 is maintained, but the slot 320 in the tool 322 is removed. As discussed herein, the slot 522 may receive pressure to stiffen or otherwise enhance sealing between the tool 222 and the mandrel hanger body 224.

Figure 6:
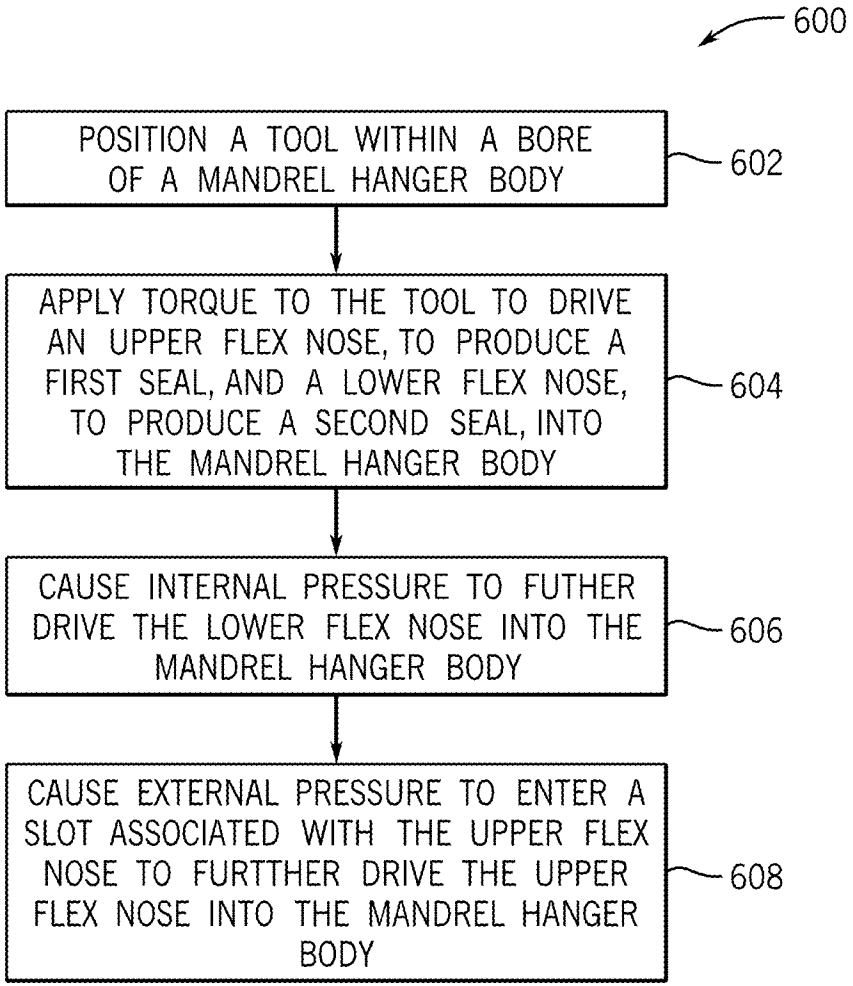
FIG. 6 is a flow chart of an example process for setting a bi-directional metal seal.

FIG. 6 illustrates a flow chart of an example process 600 to set a sealing configuration that may be used with embodiments of the present disclosure. For this process, and all other processes discussed herein, different steps or actions may be performed in a different order, or in parallel, unless explicitly stated otherwise. In this example, a tool is positioned within a bore of a mandrel hanger body 602. A torque may be applied to the tool to set one or more seals of the tool 604. For example, the torque may be used to set an upper seal associated with an upper flex nose and a lower seal associated with a lower flex nose. The respective noses may be positioned proximate different sealing locations such that one or more tapered surfaces are driven against the mandrel at a differential angle to form a M2M seal. In at least one embodiment, the seal may be a bi-directional seal. As a result, an internal pressure may further drive or enhance the lower flex nose into the mandrel hanger body 606. Additionally, an external pressure may enter a slot associated with the upper flex nose to further drive or enhance the upper flex nose into the mandrel hanger body 608. In this manner, a bi-directional M2M seal may be set with reduced torque requirements.

Embodiments may also be described in view of the following clauses:

1. A wellbore system, comprising:
a first wellbore component having a bore, the first wellbore component comprising:
a first sealing surface at an uphole axial position;
a second sealing surface at a downhole axial position; and
a first stop shoulder between the first sealing surface and the second sealing surface; and
a second wellbore component, positioned within the bore, the second wellbore component comprising:
an upper flex nose;
a slot extending at a downward angle to a position radially closer to an axis of the bore; and
a lower flex nose axially lower than the upper flex nose;
wherein the second wellbore component is coupled to the first wellbore component with a torquing force such that the upper flex nose is driven radially into the first sealing surface, the lower flex nose is driven radially into the second sealing surface, and an external pressure is directed into the slot to apply a radially outward force to the upper flex nose, on a side opposite the first sealing surface, to increase a sealing force between the upper flex nose and the first sealing surface.
2. The wellbore system of clause 1, wherein the second wellbore component further comprises:
a second stop shoulder between the upper flex nose and the lower flex nose.
3. The wellbore system of clause 2, wherein the first stop shoulder and the second stop shoulder are configured to move into contact responsive to the torquing force when the upper flex nose is aligned with the first sealing surface and the lower flex nose is aligned with the second sealing surface.
4. The wellbore system of clause 1, wherein a first metal-to-metal seal is formed between the upper flex nose and the first sealing surface and a second metal-to-metal seal is formed between the lower flex nose and the second sealing surface.
5. The wellbore system of clause 4, wherein the second metal-to-metal seal is formed before the first metal-to-metal seal.
6. The wellbore system of clause 1, wherein the first sealing surface further comprises:
a tapered surface that forms a differential angle between the first sealing surface and the upper flex nose.
7. The wellbore system of clause 1, further comprising:
a first inlay positioned in the upper flex nose, the first inlay configured to be positioned proximate the first sealing surface; and
a second inlay positioned in the lower flex nose, the second inlay configured to be positioned proximate the second sealing surface.
8. The wellbore system of clause 7, wherein the first lay and the second inlay are formed from different metals than the upper flex nose and the lower flex nose.
9. The wellbore system of clause 1, wherein the first wellbore component is a mandrel hanger body and the second wellbore component is a running tool.
10. A bi-direction sealing system, comprising:
a first seal between a first wellbore component and a second wellbore component, wherein the first seal is formed at a first interface between a first sealing surface of the first wellbore component and a first surface of a first flexible nose of the second wellbore component, wherein a slot extends into the second wellbore component at a radially interior side of the first flexible nose to direct an external pressure against the first flexible nose to drive first surface into the first sealing surface; and
a second seal between the first wellbore component and the second wellbore component, wherein the second seal is formed at a second interface between a second sealing surface of the first wellbore component and a second surface of a second flexible nose of the second wellbore component, wherein the second flexible nose is exposed to a bore pressure of the second wellbore component to receive an internal pressure against the second flexible nose to drive the second surface into the second sealing surface.
11. The bi-direction sealing system of clause 10, wherein the first seal is a metal-to-metal seal and the second seal is a metal-to-metal seal.
12 The bi-direction sealing system of clause 10, wherein the external pressure is a tubing casing annulus pressure and the internal pressure is a production pressure.
13. The bi-direction sealing system of clause 10, wherein the first seal and the second seal are formed after a rotational force is applied to the second wellbore component to couple the second wellbore component to the first wellbore component.
14. The bi-direction sealing system of clause 10, further comprising:
a third seal arranged axially between the first seal and the second seal, wherein the third seal is formed at a third interface between a third sealing surface of the first wellbore component and an elastomer seal arranged in a groove formed in the second wellbore component.
15. The bi-direction sealing system of clause 10, wherein the first seal is formed between the first sealing surface and an inlay positioned in the first flexible nose along the first surface.
16. The bi-direction sealing system of clause 10, further comprising:
a second slot extending into the second wellbore component at a radially interior side of the second flexible nose to direct the external pressure against the second flexible nose to drive second surface into the second sealing surface.
17. A wellbore system, comprising:
a first wellbore component having a tapered interior diameter, the tapered interior diameter including a first sealing location and a second sealing location;
a second wellbore component positioned radially inward from the first wellbore component, the second wellbore component comprising:
a first flexible seal leg configured to engage the first sealing location;
a second flexible seal leg configured to engage the second sealing location; and a slot extending radially into a body of the second wellbore component, the slot forming at least a portion of the first flexible seal leg;

wherein the second wellbore component, responsive to a rotational force, is driven into the tapered interior diameter such that the first flexible seal leg forms a first seal at the first sealing location and the second flexible seal leg forms a second seal at the second sealing location, and wherein the first flexible seal leg is further energized by an external pressure and the second flexible seal leg is further energized by an internal pressure.

18. The wellbore system of clause 17, wherein the internal pressure is a production pressure and the external pressure is a tubing casing annulus pressure.

19. The wellbore system of clause 17, wherein the first seal and the second seal are metal-to-metal seals.

20 The wellbore system of clause 17, further comprising:

at least one stop shoulder arranged on at least one of the first wellbore component or the second wellbore component between the first seal and the second seal.

21. A wellbore system, comprising:

a first wellbore component having a bore, the first wellbore component comprising:

a first sealing surface at an uphole axial position;

a second sealing surface at a downhole axial position; and a first stop shoulder between the first sealing surface and the second sealing surface; and a second wellbore component, positioned within the bore, the second wellbore component comprising:

an upper flex nose;

a slot extending at a downward angle to a position radially closer to an axis of the bore; and a lower flex nose axially lower than the upper flex nose;

wherein the second wellbore component is coupled to the first wellbore component with a torquing force such that the upper flex nose is driven radially into the first sealing surface, the lower flex nose is driven radially into the second sealing surface, and an external pressure is directed into the slot to apply a radially outward force to the upper flex nose, on a side opposite the first sealing surface, to increase a sealing force between the upper flex nose and the first sealing surface.

22. The wellbore system of clause 21, wherein the second wellbore component further comprises:

a second stop shoulder between the upper flex nose and the lower flex nose.

23. The wellbore system of clause 22, wherein the first stop shoulder and the second stop shoulder are configured to move into contact responsive to the torquing force when the upper flex nose is aligned with the first sealing surface and the lower flex nose is aligned with the second sealing surface.

24. The wellbore system of any of clauses 21-23, wherein a first metal-to-metal seal is formed between the upper flex nose and the first sealing surface and a second metal-to-metal seal is formed between the lower flex nose and the second sealing surface.

25. The wellbore system of clause 24, wherein the second metal-to-metal seal is formed before the first metal-to-metal seal.

26. The wellbore system of any of clauses 21-25, wherein the first sealing surface further comprises:

a tapered surface that forms a differential angle between the first sealing surface and the upper flex nose.

27. The wellbore system of any of clauses 21-26, further comprising:

a first inlay positioned in the upper flex nose, the first inlay configured to be positioned proximate the first sealing surface; and a second inlay positioned in the lower flex nose, the second inlay configured to be positioned proximate the second sealing surface.

28 The wellbore system of clause 27, wherein the first lay and the second inlay are formed from different metals than the upper flex nose and the lower flex nose.

29. The wellbore system of any of clauses 21-28, wherein the first wellbore component is a mandrel hanger body and the second wellbore component is a running tool.

30. A bi-direction sealing system, comprising:

a first seal between a first wellbore component and a second wellbore component, wherein the first seal is formed at a first interface between a first sealing surface of the first wellbore component and a first surface of a first flexible nose of the second wellbore component, wherein a slot extends into the second wellbore component at a radially interior side of the first flexible nose to direct an external pressure against the first flexible nose to drive first surface into the first sealing surface; and a second seal between the first wellbore component and the second wellbore component, wherein the second seal is formed at a second interface between a second sealing surface of the first wellbore component and a second surface of a second flexible nose of the second wellbore component, wherein the second flexible nose is exposed to a bore pressure of the second wellbore component to receive an internal pressure against the second flexible nose to drive the second surface into the second sealing surface.

31. The bi-direction sealing system of clause 30, wherein the first seal is a metal-to-metal seal and the second seal is a metal-to-metal seal.

32. The bi-direction sealing system of any of clauses 30 or 31, wherein the external pressure is a tubing casing annulus pressure and the internal pressure is a production pressure.

33. The bi-direction sealing system of any of clauses 30-32, wherein the first seal and the second seal are formed after a rotational force is applied to the second wellbore component to couple the second wellbore component to the first wellbore component.

34. The bi-direction sealing system of any of clauses 30-33, further comprising:

a third seal arranged axially between the first seal and the second seal, wherein the third seal is formed at a third interface between a third sealing surface of the first wellbore component and an elastomer seal arranged in a groove formed in the second wellbore component.

35. The bi-direction sealing system of any of clauses 30-34, wherein the first seal is formed between the first sealing surface and an inlay positioned in the first flexible nose along the first surface.

36. The bi-direction sealing system of any of clauses 30-35, further comprising:

a second slot extending into the second wellbore component at a radially interior side of the second flexible nose to direct the external pressure against the second flexible nose to drive second surface into the second sealing surface.

37. A wellbore system, comprising:

a first wellbore component having a tapered interior diameter, the tapered interior diameter including a first sealing location and a second sealing location;

a second wellbore component positioned radially inward from the first wellbore component, the second wellbore component comprising:

a first flexible seal leg configured to engage the first sealing location;

a second flexible seal leg configured to engage the second sealing location; and a slot extending radially into a body of the second wellbore component, the slot forming at least a portion of the first flexible seal leg;

wherein the second wellbore component, responsive to a rotational force, is driven into the tapered interior diameter such that the first flexible seal leg forms a first seal at the first sealing location and the second flexible seal leg forms a second seal at the second sealing location, and wherein the first flexible seal leg is further energized by an external pressure and the second flexible seal leg is further energized by an internal pressure.

38. The wellbore system of clause 37, wherein the internal pressure is a production pressure and the external pressure is a tubing casing annulus pressure.

39. The wellbore system of any of clauses 37 or 38, wherein the first seal and the second seal are metal-to-metal seals.

40. The wellbore system of any of clauses 37-39, further comprising:

at least one stop shoulder arranged on at least one of the first wellbore component or the second wellbore component between the first seal and the second seal.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A wellbore system, comprising:

a first wellbore component having a bore, the first wellbore component comprising:

a first sealing surface at an uphole axial position;

a second sealing surface at a downhole axial position; and a first stop shoulder between the first sealing surface and the second sealing surface; and a second wellbore component, positioned within the bore, the second wellbore component comprising:

an upper flex nose;

a slot extending at a downward angle to a position radially closer to an axis of the bore; and a lower flex nose axially lower than the upper flex nose, wherein the lower flex nose forms a portion of an axially lowest portion of the second wellbore component;

wherein the second wellbore component is coupled to the first wellbore component with a torquing force such that the upper flex nose is driven radially into the first sealing surface, the lower flex nose is driven radially into the second sealing surface, and an external pressure is directed into the slot to apply a radially outward force to the upper flex nose, on a side opposite the first sealing surface, to increase a sealing force between the upper flex nose and the first sealing surface.

2. The wellbore system of claim 1, wherein the second wellbore component further comprises:

a second stop shoulder between the upper flex nose and the lower flex nose.

3. The wellbore system of claim 2, wherein the first stop shoulder and the second stop shoulder are configured to move into contact responsive to the torquing force when the upper flex nose is aligned with the first sealing surface and the lower flex nose is aligned with the second sealing surface.

4. The wellbore system of claim 1, wherein a first metal-to-metal seal is formed between the upper flex nose and the first sealing surface and a second metal-to-metal seal is formed between the lower flex nose and the second sealing surface.

5. The wellbore system of claim 4, wherein the second metal-to-metal seal is formed before the first metal-to-metal seal.

6. The wellbore system of claim 1, wherein the first sealing surface further comprises:

a tapered surface that forms a differential angle between the first sealing surface and the upper flex nose.

7. The wellbore system of claim 1, further comprising:

a first inlay positioned in the upper flex nose, the first inlay configured to be positioned proximate the first sealing surface; and a second inlay positioned in the lower flex nose, the second inlay configured to be positioned proximate the second sealing surface.

8. The wellbore system of claim 7, wherein the first inlay and the second inlay are formed from different metals than the upper flex nose and the lower flex nose.

9. The wellbore system of claim 1, wherein the first wellbore component is a mandrel hanger body and the second wellbore component is a running tool.

10. A bi-directional sealing system, comprising:

a first seal between a first wellbore component and a second wellbore component, wherein the first seal is formed at a first interface between a first sealing surface of the first wellbore component and a first surface of a first flexible nose of the second wellbore component, wherein a slot extends into the second wellbore component at a radially interior side of the first flexible nose to direct an external pressure against the first flexible nose to drive first surface into the first sealing surface; and a second seal between the first wellbore component and the second wellbore component, wherein the second seal is formed at a second interface between a second sealing surface of the first wellbore component and a second surface of a second flexible nose of the second wellbore component, wherein the second flexible nose is exposed to a bore pressure of the second wellbore component to receive an internal pressure against the second flexible nose to drive the second surface into the second sealing surface and the second flexible nose forms a portion of an axially lowest portion of the second wellbore component.

11. The bi-directional sealing system of claim 10, wherein the first seal is a metal-to-metal seal and the second seal is a metal-to-metal seal.

12. The bi-directional sealing system of claim 10, wherein the external pressure is a tubing casing annulus pressure and the internal pressure is a production pressure.

13. The bi-directional sealing system of claim 10, wherein the first seal and the second seal are formed after a rotational force is applied to the second wellbore component to couple the second wellbore component to the first wellbore component.

14. The bi-directional sealing system of claim 10, further comprising:

a third seal arranged axially between the first seal and the second seal, wherein the third seal is formed at a third interface between a third sealing surface of the first wellbore component and an elastomer seal arranged in a groove formed in the second wellbore component.

15. The bi-directional sealing system of claim 10, wherein the first seal is formed between the first sealing surface and an inlay positioned in the first flexible nose along the first surface.

16. The bi-directional sealing system of claim 10, further comprising:

a second slot extending into the second wellbore component at a radially interior side of the second flexible nose to direct the external pressure against the second flexible nose to drive second surface into the second sealing surface.

17. A wellbore system, comprising:

a first wellbore component having a tapered interior diameter, the tapered interior diameter including a first sealing location and a second sealing location;

a second wellbore component positioned radially inward from the first wellbore component, the second wellbore component comprising:

a first flexible seal leg configured to engage the first sealing location;

a second flexible seal leg configured to engage the second sealing location, the second flexible seal leg forming a portion of an axially lowest portion of the second wellbore component; and a slot extending radially into a body of the second wellbore component, the slot forming at least a portion of the first flexible seal leg;

wherein the second wellbore component, responsive to a rotational force, is driven into the tapered interior diameter such that the first flexible seal leg forms a first seal at the first sealing location and the second flexible seal leg forms a second seal at the second sealing location, and wherein the first flexible seal leg is further energized by an external pressure and the second flexible seal leg is further energized by an internal pressure.

18. The wellbore system of claim 17, wherein the internal pressure is a production pressure and the external pressure is a tubing casing annulus pressure.

19. The wellbore system of claim 17, wherein the first seal and the second seal are metal-to-metal seals.

20. The wellbore system of claim 17, further comprising:

at least one stop shoulder arranged on at least one of the first wellbore component or the second wellbore component between the first seal and the second seal.

* * * * *